US007971279B2

(12) United States Patent
Abanto et al.

(10) Patent No.: US 7,971,279 B2
(45) Date of Patent: Jul. 5, 2011

(54) AUTOMATIC ZIPPER MECHANISM FOR CLOTHING

(76) Inventors: Edward A. Abanto, Dumont, NJ (US); Rimah A. Abanto, Dumont, NJ (US)

( * ) Notice: Subject to any disclaimer, the term of this patent is extended or adjusted under 35 U.S.C. 154(b) by 734 days.

(21) Appl. No.: 12/150,750

(22) Filed: May 1, 2008

(65) Prior Publication Data

US 2009/0178246 A1 Jul. 16, 2009

Related U.S. Application Data

(60) Provisional application No. 61/011,019, filed on Jan. 14, 2008.

(51) Int. Cl.
*A41D 1/06* (2006.01)
*A44B 19/26* (2006.01)

(52) U.S. Cl. ..... 2/234; 2/218; 24/439; 24/436

(58) Field of Classification Search ..... 24/429, 24/436; 2/236, 237, 234, 218, 405
See application file for complete search history.

(56) References Cited

U.S. PATENT DOCUMENTS

| | | | | |
|---|---|---|---|---|
| 3,448,463 | A * | 6/1969 | Milone Gaetano | 2/234 |
| 5,347,688 | A * | 9/1994 | Ross | 24/429 |
| 5,586,368 | A * | 12/1996 | Nelson | 24/429 |
| 5,732,447 | A * | 3/1998 | Nolen et al. | 24/429 |
| 7,111,714 | B1 * | 9/2006 | Bell, III | 24/429 |
| 7,200,901 | B2 * | 4/2007 | Pitts et al. | 24/436 |

* cited by examiner

*Primary Examiner* — Robert J Sandy
(74) *Attorney, Agent, or Firm* — Clifford G. Frayne

(57) ABSTRACT

An opening and closure mechanism for a zipper, the mechanism including a resilient elastic band or strap secured to the zipper handle with opposing ends of the resilient elastic strap being secured to at least one side of the waist band closure, and preferably opposing ends of the resilient elastic strap being secured to opposing sides of the waist band closure such that separating the waist band closure causes the resilient elastic strap to open the zipper closure mechanism by retracting the zipper handle downwardly; and closure of the waist band fastener releases tension on the resilient elastic strap allowing the resilient elastic strap to retract the zipper upwardly to a closed position.

3 Claims, 4 Drawing Sheets

AUTOMATIC ZIPPER MECHANISM FOR CLOTHING

RELATED APPLICATIONS

Applicant claims the benefit of provisional application Ser. No. 61/011,019, filed Jan. 14, 2008.

BACKGROUND OF THE INVENTION

1. Field of the Invention

The present invention relates to a opening and closure mechanism for zippered clothing, such as mens pants and shorts, and womens pants, shorts, and skirts, and more particularly to a zipper and elastic band or strap mechanism which automatically lowers the zipper when the clothing is unfastened at the waist, and which automatically closes the zipper when the clothing is fastened at the waist.

2. Description of the Prior Art

Zippered open/closure mechanisms are used commonly with respect to clothing and are most commonly utilized on mens and womens pants and shorts, and on womens skirts. The zipper open/closure mechanism is normally associated with an additional open/closure mechanism at the waist in the form of a waist fastener, such as a button and button hole, or a slidably engageable clip on the interior of the overlapping waist band. Both the zipper open/closure mechanism and the waist band open/closure mechanisms are manually operated. Waist band open/closure mechanisms position one part of the fastener (i.e. button) on one flap or placket of the waist band and the other element of the fastener on the opposing flap or placket of the waist band, the flaps or plackets defining by the fabric slit for the zipper.

Applicant's closure assembly incorporates a resilient elastic band or strap with the waist band and the zipper handle in order to automatically lower the zipper when the waist band fastener is undone and separated, and to automatically raise and close the zipper when the waist band fastener is in its closed orientation.

OBJECTS OF THE INVENTION

An object of the present invention is to provide for a novel automatic closure mechanism for raising a zipper to a closed position when the waist fastener is secured and for lowering the zipper when the waist fastener is unsecured.

Another object of the present invention is to provide for a novel automatic zipper mechanism in which the zipper handle and the waist band flaps or plackets of the piece of clothing are in communication by means of a resilient elastic member.

A still further object of the present invention is to provide for a zipper which eliminates the zipper handle from becoming jammed or stuck when in operation.

SUMMARY OF THE INVENTION

An opening and closure mechanism for a zipper, the mechanism comprising a resilient elastic band or strap secured to the zipper handle with opposing ends of the resilient elastic strap being secured to at least one side of the waist band closure, and preferably opposing ends of the resilient elastic strap being secured to opposing sides of the waist band closure such that separating the waist band closure causes the resilient elastic strap to open the zipper closure mechanism by retracting the zipper handle downwardly; and closure of the waist band fastener releases tension on the resilient elastic strap allowing the resilient elastic strap to retract the zipper upwardly to a closed position.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
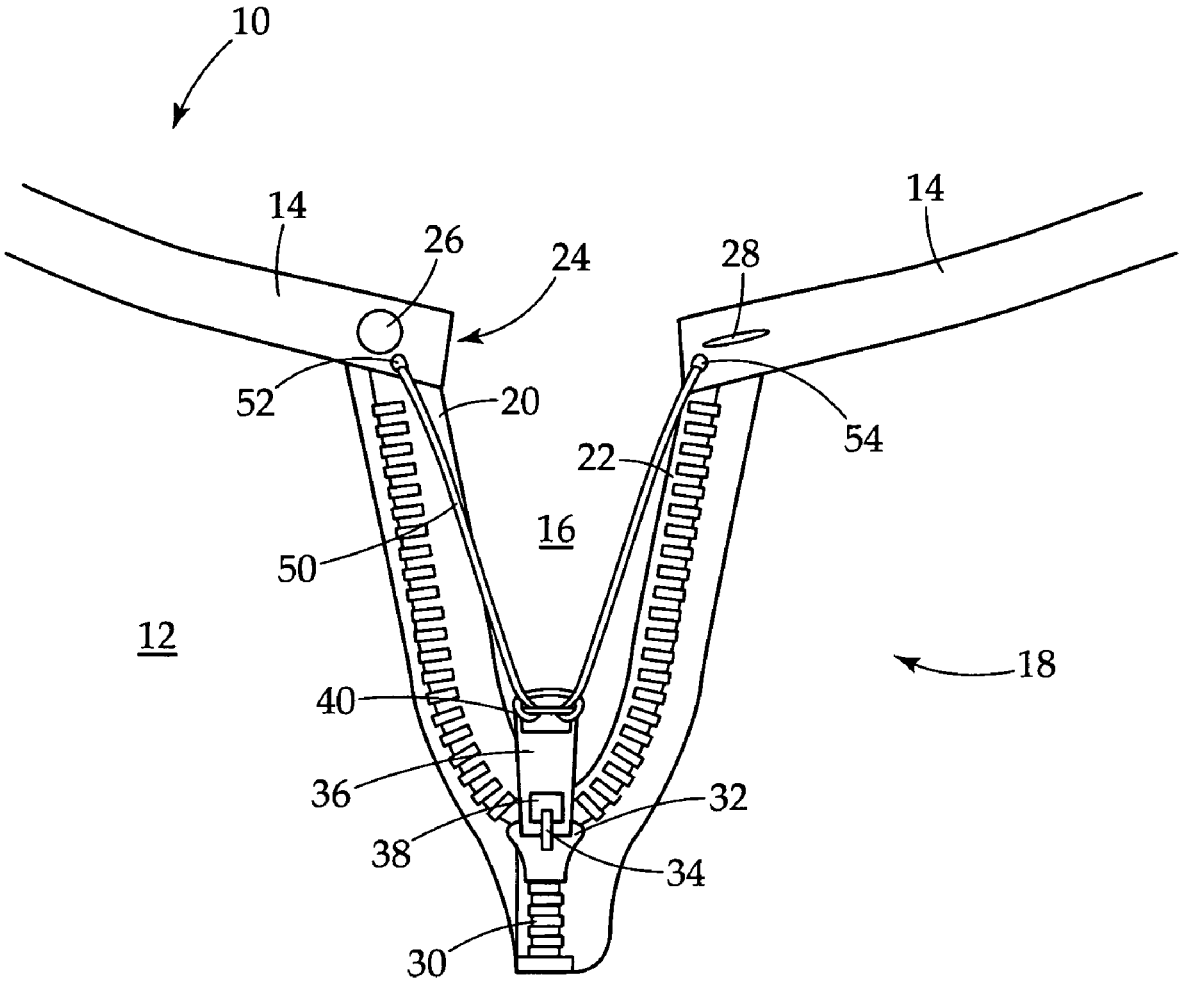
FIG. 1 is a close up view of the opening and closure mechanism of the present invention.

FIG. 1 is a close up view of the zipper mechanism of the present invention associated with a pair of shorts 10. The shorts 10 have a lower torso portion 12 defined by an upper waistband 14, waistband 14 being divided by a slit 16 in the cloth for the installation of a standard zipper mechanism 18. Waistband 14 as a result of a slit 16 is defined by two plackets 20 and 22. Waistband 14 would normally have a waistband fastener 24, which in FIG. 1 is illustrated by a button 26 on one placket 20 and a buttonhole 28 on the opposing placket 22 such when the waistbands are overlapped, the button 26 is inserted through the buttonhole 28 and secures the waistband 14.

The opposing plackets 20 and 22 have formed thereon a standard zipper mechanism 18. The zipper mechanism 18 comprises opposing interlockable teeth 30 formed on opposing plackets 20 and 22, a zipper slide fastener 32 which in an upward movement interlocks the opposing teeth 30 on opposing plackets to close the zipper, and which in a downward movement unlocks the opposing teeth 30 to open the zipper.

Zipper slide fastener 32 is formed with a hook member 34 on which is positioned a fingertip handle member 36 for manually manipulating the zipper mechanism 18. Fingertip handle member 36 is formed with a first aperture 38 which engages hook member 34 on the slide fastener 32 and a second aperture 40 formed at its opposing end.

A resilient elastic member 50 in the form of a strap is removably engaged with fingertip handle member 36 by means of second aperture 40. A first end 52 of resilient elastic strap 50 is secured to the button 26 side of waistband member 14 and a second end 54 of resilient elastic strap 50 is secured to the buttonhole 28 side of the waistband member 14. The manner of securing a first end and second end of resilient elastic member 50 could be by needle and thread, staple or any other suitable securing means.

Figure 2:
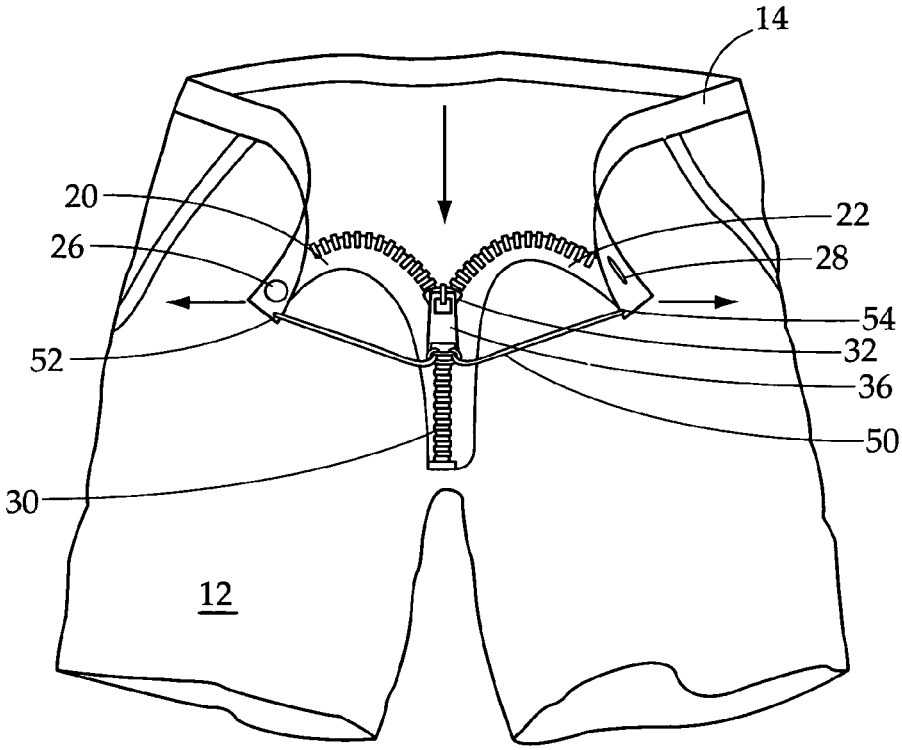
FIG. 2 is a front view of the opening and closure mechanism of the present invention in an opening orientation.
Figure 3:
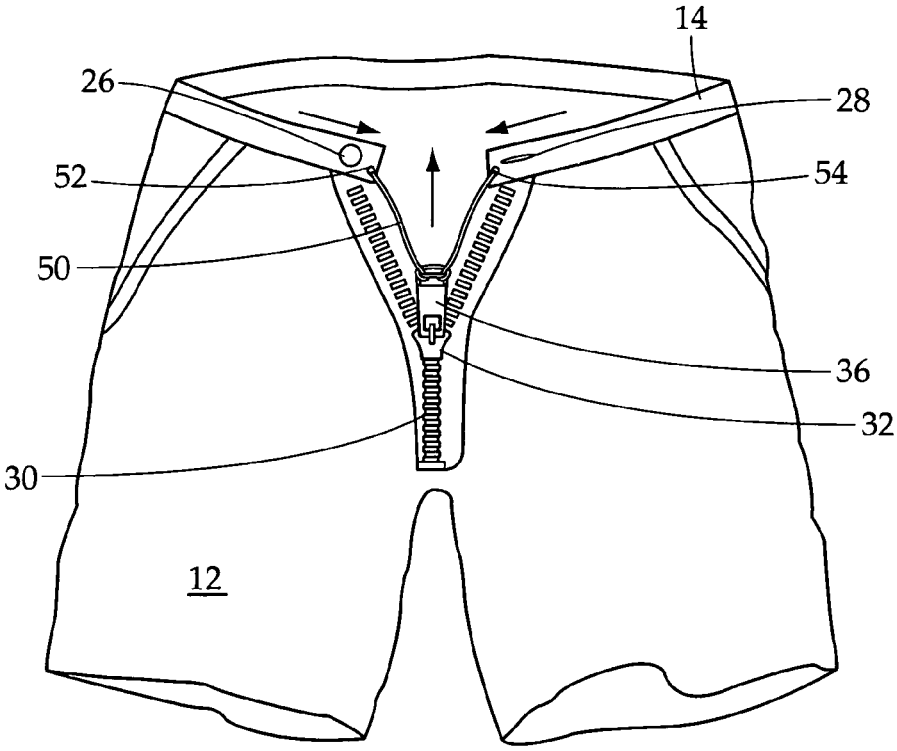
FIG. 3 is a front view of the opening and closure mechanism of the present invention in a retractable or closing orientation.

FIGS. 2 and 3 illustrate the operation of the resilient elastic strap 50 when it is desired to remove or put on the particular garment, the garment in FIGS. 2 and 3 being illustrated as a pair of shorts. In removing the pair of shorts 10, the waistband fastener in the form of a button 26 and buttonhole 28 as illustrated, is first unfastened. The respective portions of the waistband 14 and plackets 20 and 22 are then separated outwardly to the hips as illustrated by the arrows. This motion places tension on the resilient elastic strap 50 causing the resilient elastic strap 50 to exert a force upon the fingertip handle member 36 and the slide fastener 32 of the zipper mechanism causing the slide fastener 32 of the zipper mechanism to move downwardly disengaging the teeth 30 of the zipper mechanism, thereby opening the zipper.

In the reverse operation when the individual wishes to place the pair of shorts on, the plackets 20 and 22 of waistband member 14 are separated with the zipper mechanism being open such that the zipper slide fastener 32 is in its lowest position. As the waistband members 14 are drawn together so as to engage the waistband fastener, i.e. button 26 and buttonhole 28, the tension on the resilient elastic strap 50 is lessened such that it returns to its non-tension orientation thereby causing the fingertip handle member 36 and zipper slide fastener 32 to move upwardly, the zipper slide fastener 32 engaging the teeth 30 of the zipper, and thus closing the zipper mechanism.

Figure 4:
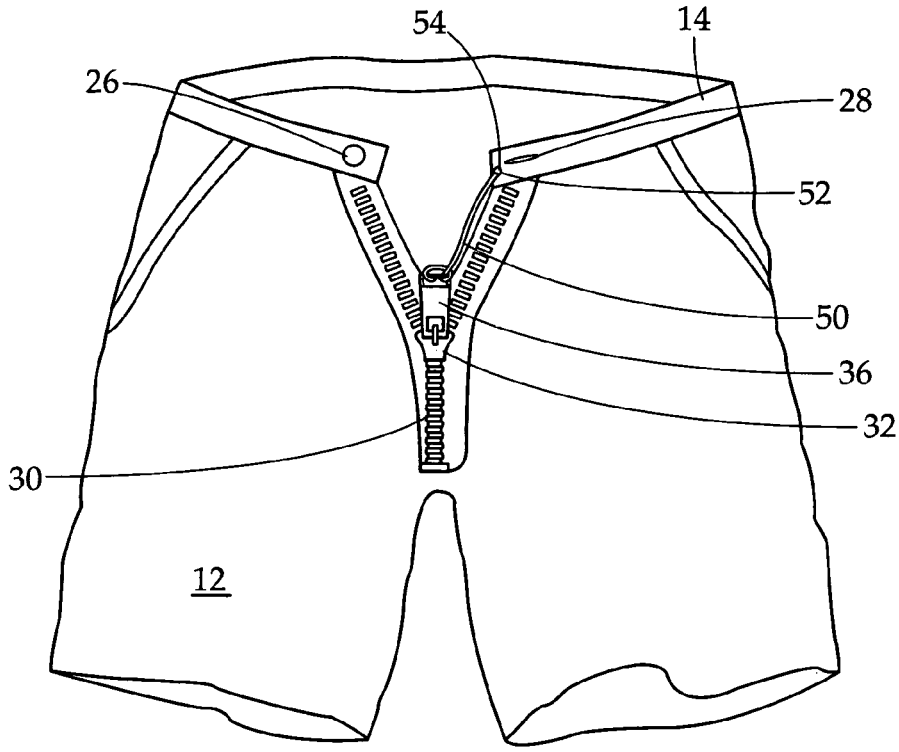
FIGS. 4 and 5 are front views of alternative embodiments of the present invention.
Figure 5:
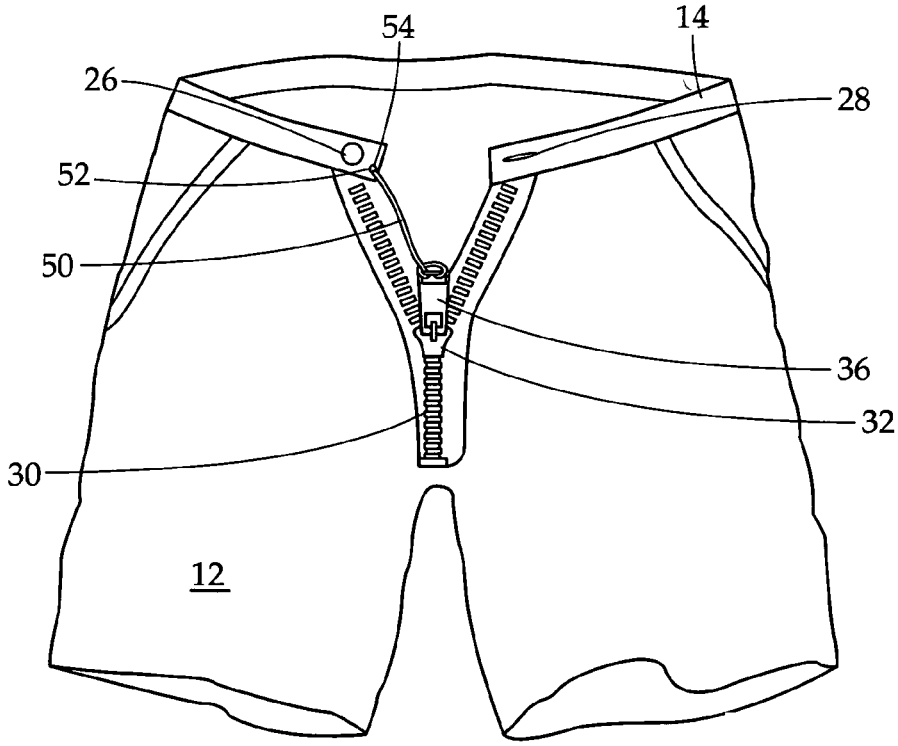

FIGS. 1, 2, and 3 illustrate an automatic zipper mechanism of the present invention in which the resilient elastic strap is secured to opposing sides of the waistband. FIGS. 4 and 5 illustrate an embodiment where the resilient elastic strap 50 is secured to the fingertip handle member 36 of the zipper mechanism in the same manner as in FIGS. 1, 2, and 3, but in the embodiments of FIGS. 4 and 5, both first and second ends 52 and 54 of the resilient elastic strap 50 are secured to the same waistband side of the shorts. In FIG. 4 both the first end and second end 52 and 54 of resilient elastic strap 50 are secured to the buttonhole 28 side of waistband 14 and in FIG. 5, both the first end and second end 52 and 54 of the resilient elastic strap 50 are secured to the button 26 side of waistband 14. In both embodiments illustrated in FIGS. 4 and 5, the operation of the zipper mechanism is the same as previously described and illustrated in FIGS. 6 and 7.

Figure 6:
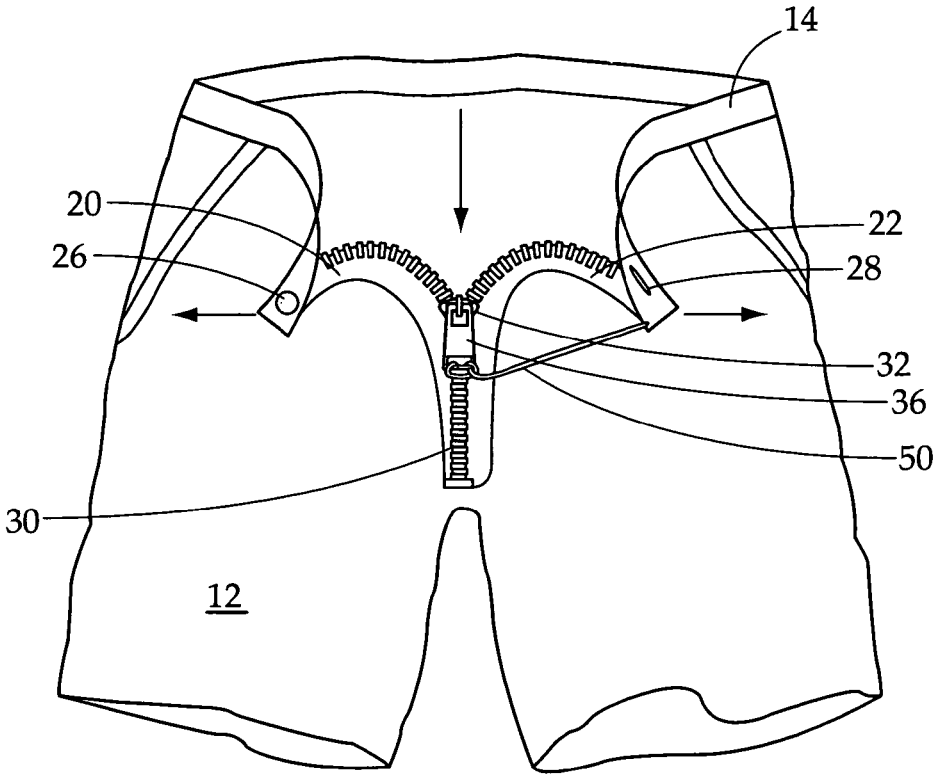
FIGS. 6 and 7 are front views of FIGS. 4 and 5 illustrating the opening and closure of the zipper closure of FIGS. 4 and 5.
Figure 7:
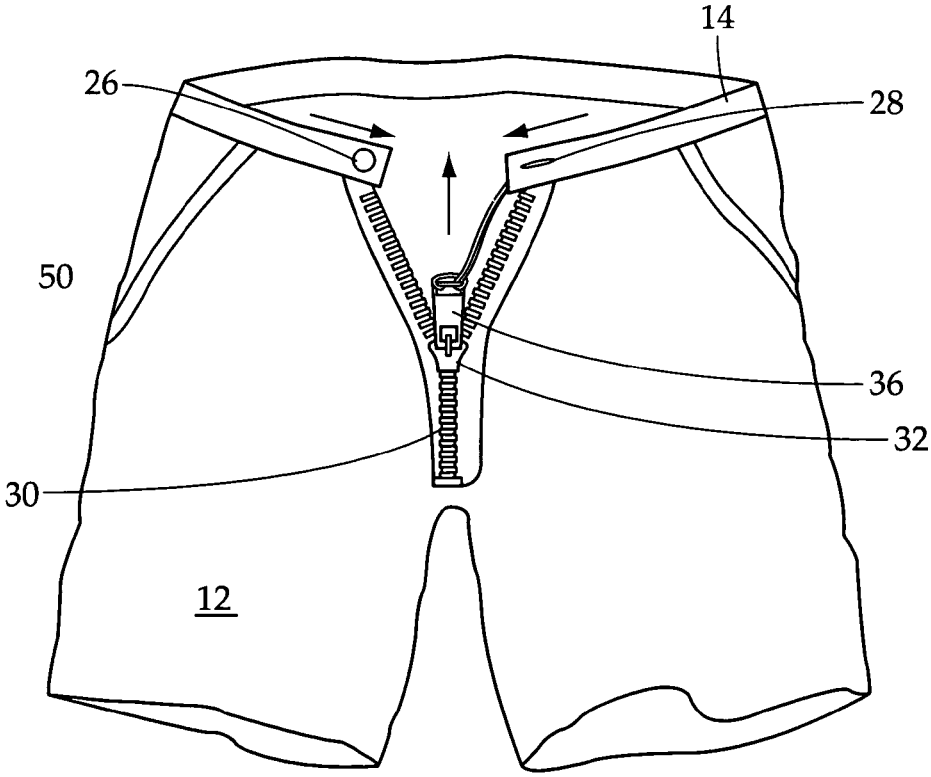

FIGS. 6 and 7 are illustrative of the action of the automatic zipper with respect to the embodiments illustrated in FIGS. 4 and 5.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

We claim:

1. An automatic zipper for garments and clothing for retracting a zipper downwardly and retracting a zipper upwardly, the automatic zipper having particular application to pants, trousers, shorts, and skirts, said automatic zipper comprising:

a garment or clothing having a waist band closure having opposing overlapping plackets, each placket having complimentary closure members, said closure members in the form of a button and button hole, or interlocking clips, each placket having a vertically oriented tooth zipper member interlockable with its opposing tooth zipper member by means of a vertical slide fastener having a finger handle, said interlocked tooth zipper members disengageable by a downward motion of the vertical slide fastener and finger handle, said automatic zipper having an elastic strap band engageable with said finger handle and secured to at least one of the overlapping plackets of said waist band closure, the disengagement of said waist band closure and separation of said overlapping plackets in opposing directions tension said elastic strap band causing said slide fastener and said finger member to retract downwardly, disengaging said toothed zipper members, engagement of said waist band closure by overlapping said plackets releasing tension on said vertical slide fastener and said finger handle moving them upwardly and interlocking said toothed zipper members closing said zipper.

2. An automatic zipper for garments and clothing in accordance with claim 1 wherein said elastic strap band secured to said finger handle of said vertical slide fastener is formed with two opposing ends, said opposing ends secured to said opposing overlapping plackets at said waistband closure.

3. An automatic zipper for garments and clothing in accordance with claim 1 wherein said elastic strap band is secured to said finger handle of said slide member and one of said opposing overlapping plackets of said waist band closure.

* * * * *